US006288375B1

(12) United States Patent
Lappi et al.

(10) Patent No.: US 6,288,375 B1
(45) Date of Patent: Sep. 11, 2001

(54) CONFORMABLE LOOP INDUCTION HEATING APPARATUS AND METHOD FOR ACCELERATED CURING OF BONDED MEMBERS

(75) Inventors: Larry R. Lappi; Robert J. Boettcher, both of Stillwater, MN (US); David G. Miller; Richard F. Miller, both of Warren, OH (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/422,608

(22) Filed: Oct. 21, 1999

(51) Int. Cl.[7] ..... H05B 6/10; H05B 6/40

(52) U.S. Cl. ..... 219/633; 219/635; 219/672; 219/675; 156/272.4; 156/380.2

(58) Field of Search ..... 219/633, 634, 219/635, 603, 672, 675, 676, 647; 156/272.4, 274.2, 379.6, 379.7, 380.2

(56) References Cited

U.S. PATENT DOCUMENTS

| | | | | |
|---|---|---|---|---|
| 3,396,258 | | 8/1968 | Leatherman . | |
| 4,163,884 | | 8/1979 | Kobetsky . | |
| 4,174,994 | * | 11/1979 | Savelkouls | 156/380 |
| 4,521,659 | | 6/1985 | Buckley et al. . | |
| 4,532,396 | | 7/1985 | Burack et al. . | |
| 4,590,347 | | 5/1986 | Thatcher et al. . | |
| 4,602,139 | | 7/1986 | Hutton et al. . | |
| 4,771,151 | * | 9/1988 | Pursell | 219/633 |
| 4,950,348 | | 8/1990 | Larsen . | |
| 4,992,133 | * | 2/1991 | Border | 219/633 |
| 5,087,804 | | 2/1992 | McGaffigan . | |
| 5,397,876 | | 3/1995 | Shimamoto et al. . | |
| 5,442,159 | | 8/1995 | Shank . | |
| 5,481,091 | * | 1/1996 | Grimm et al. | 219/633 |
| 5,523,546 | | 6/1996 | Lake . | |
| 5,847,370 | | 12/1998 | Sluka et al. . | |
| 5,919,388 | | 7/1999 | Kawano et al. . | |

FOREIGN PATENT DOCUMENTS

| | | | | |
|---|---|---|---|---|
| 30 19 676 | * | 12/1981 | (DE) | 219/675 |
| 44 28 565 A1 | | 6/1995 | (DE) . | |
| WO 99/48334 | | 9/1999 | (WO) . | |

* cited by examiner

*Primary Examiner*—Philip H. Leung
(74) *Attorney, Agent, or Firm*—Scott R. Pribnow

(57) ABSTRACT

An induction heating apparatus and method for heating a substantially continuous first bondline defined by a length of thermally responsive bonding material positioned between a first member and a second member. The first member or second member is made of an electrically conductive material or positioned adjacent an electrically conductive material. The inductive heating apparatus includes a flexible, reshapeable cable assembly operably positionable adjacent the first member along the first bondline. The flexible, reshapeable cable assembly is capable of being manually shaped to a first shape of the first bondline, and is capable of being manually re-shaped to a second shape of a second bondline different than the first shape of the first bondline. An alternating current power supply is electrically coupled to the flexible, reshapeable cable assembly. When the alternating current power supply is activated the reshapeable cable assembly operates to inductively heat the electrically conductive material for conductive heating of the thermally responsive bonding material substantially uniformly along the first bondline.

19 Claims, 6 Drawing Sheets

CONFORMABLE LOOP INDUCTION HEATING APPARATUS AND METHOD FOR ACCELERATED CURING OF BONDED MEMBERS

TECHNICAL FIELD

The present invention relates generally to a conformable loop heating apparatus and method for reducing the cure time of a geometrically shaped bondline defined by a thermally responsive bonding material positioned between two members, the apparatus including a manually reshapeable cable assembly positionable adjacent the shaped bondline.

BACKGROUND OF THE INVENTION

In the automotive industry, exterior metal panels (i.e., closure panels) on vehicles are attached to the vehicle structure during manufacturing using resistance spot welds. Non-metal panels are attached to the metal structure with adhesives or by mechanical fasteners. Subsequent replacement of a metal panel (e.g., due to damage from a collision) is typically accomplished by welding or by a combination of welding and bonding the panel to the metal structure. Thermally responsive bonding materials (e.g., thermally curable adhesives) are utilized for bonding a replacement panel to the metal structure. The cure times of a thermally responsive bonding material can be reduced by applying heat to the bonding material. The bonding materials utilized are typically one-part or two-part adhesives. Such adhesives may be epoxy, urethane, acrylic, or acrylic-epoxy based adhesives.

In the collision repair process, the bonding material is either applied to the replacement panel or to the vehicle structure, or both. The panel is fixed in proper alignment with the vehicle structure. The panels must remain stationary in a heated shop to cure the bonding material until the bonding material has at least developed handling strength. During the time that a collision repair shop waits for the bonding material to cure, the vehicle occupies valuable shop space which could be utilized for other purposes. Different two-part adhesives require varying times to cure adequately to achieve handling strength, and even longer cure times are required for the adhesive to reach its full structural strength. One-part adhesives are not used as frequently in collision repair since one-part adhesives usually require moisture or heat to cure the adhesive. Moisture is known to be slow to penetrate into a thin adhesive bondline sandwiched between a replacement panel and the vehicle structure.

A collision repair shop is required to replace many different sizes and shapes of vehicle closure panels. Known heating apparatuses and methods for accelerating bonding material cure times include infra-red heat lamps, silicon-coated resistant heat tapes, hot-air heat guns, and paint bake booths. Each of the above methods have known disadvantages. Infra-red heaters can provide high-heat to broad areas. However, the high temperature necessary for rapidly curing some bonding materials may also cause damage to unprotected adjacent heat sensitive materials in/on the vehicle. Silicon-coated resistance heat tapes can be taped or clamped along a bondline. As the tape heats, it expands and portions "lift up" from the heated surface. The areas of the bondlines under the raised portions of the heat tape may not receive adequate heat. Paint bake booths can be used for accelerating the cure time of a bonding material, but the whole vehicle occupies a very expensive piece of equipment necessary for curing paints. Some paint bake booths can not be heated to an adequate temperature to cure known structural bonding tapes (SBT) or one-part paste adhesives. If such high temperatures were obtained, the heat could also damage heat sensitive components of the vehicle. Hot air heat guns are able to obtain the temperatures necessary to accelerate the cure of thermal bonding materials. However, curing of a bondline with a point source heater like a heat gun is a very time consuming operation. Only small sections or "spots" of the bondline are heated at a time. In use of a heat gun, it may not be very easy to uniformly control the ultimate bonding material temperature. This may result in overheating of the bonding material to a point of decomposition. Alternatively, inadequate heat could result in an incomplete cure.

Induction heating has been known to be used in the manufacture and assembly of automotive vehicles involving high production rates of similar parts. Electric induction coils are employed to provide heat to accelerate the curing of thermally responsive bonding materials positioned between juxtaposed metal sheets. Such induction coils carry high frequency electrical current which generates a magnetic field and causes heating of the metal sheets. Heat is conducted from the metal sheets to the bonding material disposed between the metal sheets. Known methods of induction heating include the use of spot induction heaters or rigid copper induction applicators. Spot induction heaters concentrate a large amount of heat at a small, localized area or "spot". It is common to employ spot induction heaters at selected locations along the length of a bondline so as to spot cure the bonding material at the locations of the induction coils to achieve handling strength. The remainder of the bonding material is cured at a later time during the assembly process, such as when the automotive vehicle passes through a paint bake booth. One known spot induction heater is disclosed in U.S. Pat. No. 5,442,159 to Shank issued Aug. 15, 1995.

The use of rigid copper induction applicators requires a different shaped applicator for each different shaped bondline or panel geometry. Such rigid induction applicators would not be desirable for use at a collision repair shop, which often requires bondlines of a different panel geometry for each use. Further, due to the high current in the inductor, rigid copper induction applicators often require additional cooling (e.g., a water cooling system) to avoid overheating of the rigid copper induction applicator. One known rigid copper induction applicator is disclosed in U.S. Pat. No. 4,602,139 to Hutton et al. issued on Jul. 22, 1986.

SUMMARY OF THE INVENTION

The present invention provides an induction heating apparatus and method for heating a substantially continuous bondline defined by a length of thermally responsive bonding material positioned between a first member and a second member. The first member or second member is made of an electrically conductive material or positioned adjacent an electrically conductive material. The inductive heating apparatus includes a flexible, reshapeable cable assembly positionable adjacent the first member along the first bondline. The flexible, reshapeable cable assembly is capable of being manually shaped to a first shape of the first bondline, and is capable of being manually re-shaped to a second shape of a second bondline different than the first shape of the first bondline. An alternating current power supply is electrically coupled to the flexible, reshapeable cable assembly. When the alternating current power supply is activated the reshapeable cable assembly operates to inductively heat the electrically conductive material for conductive heating of the thermally responsive bonding material substantially uniformly along the first bondline.

The flexible, reshapeable cable assembly is positionable in a non-dipole or dipole configuration adjacent the first bondline. In one aspect, the flexible, reshapeable cable assembly is positionable adjacent the second member along the first bondline.

In one aspect, the flexible, reshapeable cable assembly includes a plurality of wires stranded together. The cable assembly may further comprise a first insulating layer covering each wire forming an insulated wire, and a jacket layer covering all of the insulated wires. In one aspect, the first insulating layer is made of a polymeric material. In one aspect, the jacket layer is made of a polymeric material. In one preferred aspect, the flexible, reshapeable cable assembly is a litz wire.

The alternating current power supply is a high frequency power supply having an output frequency greater than 1 kilohertz. In one aspect, the output frequency is between 10 kilohertz and 400 kilohertz.

The inductive heating apparatus may further include a controller coupled to the power supply for controlling activation of the power supply. The controller may further include a timer for controlling the duration of application of power via the power supply. The controller may further include a frequency control mechanism for changing the output pulse frequency.

A securing mechanism is provided for securing the flexible, reshapeable cable assembly to the first member. In one aspect, the securing mechanism is tape. In another aspect, the securing mechanism includes a magnetic material form magnetically coupling the cable assembly to the first member. In another aspect, the securing mechanism is a fixturing clamp.

In one aspect, the first member is a sheet, and the flexible, reshapeable cable assembly is manually formed to substantially a perimeter shape of the sheet. The flexible, reshapeable cable assembly has three dimensional conformability. The flexible, reshapeable cable assembly is substantially non-resilient.

In another embodiment, the present invention provides a method of bonding two juxtaposed members. The method of bonding includes reducing the curing time to reach handling strength of a thermally responsive bonding material positioned between a first member and a second member which defines a substantially continuous bondline. The first member or second member is made of an electrically conductive material or positioned adjacent an electrically conductive material. The method includes the steps of providing a flexible, reshapeable cable assembly. The flexible, reshapeable cable assembly is positioned adjacent the first member along the first bondline, including manually shaping the flexible, reshapeable cable assembly to a first shape of the first bondline. The flexible, reshapeable cable assembly is coupled to an alternating current power supply. The alternating current power supply is activated to inductively heat the electrically conductive material for conductive heating of the thermally responsive material substantially uniformly along the first bondline.

In one aspect, the flexible, reconfigurable cable assembly is defined to include a plurality of wires stranded together. The step of defining the flexible, reconfigurable cable assembly includes an insulating layer covering each wire forming an insulated wire, and a jacket layer covering all of the insulated wires. In one aspect, the flexible, reshapeable cable assembly is a litz wire. The method further includes the step of defining the alternating current power supply as a high frequency power supply having an output frequency greater than 1 kilohertz. In one aspect, the output frequency is between 10 kilohertz and 400 kilohertz.

The method may further include the step of coupling a controller to the power supply and controlling activation of the power supply using the controller. The method may further include the step of securing the flexible, reshapeable cable assembly to the first member along the first bondline. The method may further include the step of removing the flexible, reshapeable cable assembly from the first bondline, and manually reshaping the flexible, reshapeable cable assembly to a second shape of a second bondline, different from the first shape of the first bondline.

In one aspect, the first bondline has a three-dimensional shape. A flexible, reshapeable cable assembly conforms along the first bondline to the three-dimensional shape. The step of positioning the flexible, reshapeable cable assembly adjacent the first member further includes the step of positioning the flexible, reshapeable cable assembly adjacent the second member along the first bondline. The flexible, reshapeable cable assembly is positionable adjacent the first member along the first bondline in a non-dipole manner.

In another embodiment the present invention provides an inductive heating apparatus for heating a substantially continuous first bond line defined by a length of thermally responsive bonding material positioned adjacent a first member, wherein the first member is made of an electrically conductive material or positioned adjacent an electrically conductive material. The inductive heating apparatus includes a flexible, reshapeable cable assembly operably positioned adjacent the first member along the first bondline. The flexible, reshapeable cable assembly is capable of being manually shaped to a first shape of the first bondline, and is capable of being manually re-shaped to a second shape of a second bondline different than the first shape of the first bondline. A power supply is electrically coupled to the flexible, reshapeable cable assembly. When the power supply is activated the reshapeable cable assembly operates to inductively heat the electrically conductive material for conductive heating of the thermally responsive bonding material substantially uniformly along the first bondline.

In another embodiment, the present invention provides a method of debonding one or more members, including reducing the curing time of a thermally responsive bonding material positioned adjacent a first member which defines a substantially continuous first bondline. The first member is made of an electrically conductive material or positioned adjacent an electrically conductive material. The method includes the step of providing a flexible, reshapeable cable assembly. The flexible, reshapeable cable assembly is positioned adjacent the first member along the first bondline, including manually shaping the flexible, reshapeable cable assembly to a first shape of the first bondline. The flexible, reshapeable cable assembly is coupled to a power supply. The power supply is activated to inductively heat the electrically conductive material for conductive heating of the thermally responsive material substantially uniform along the first bondline.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures.

DETAILED DESCRIPTION

Figure 1:
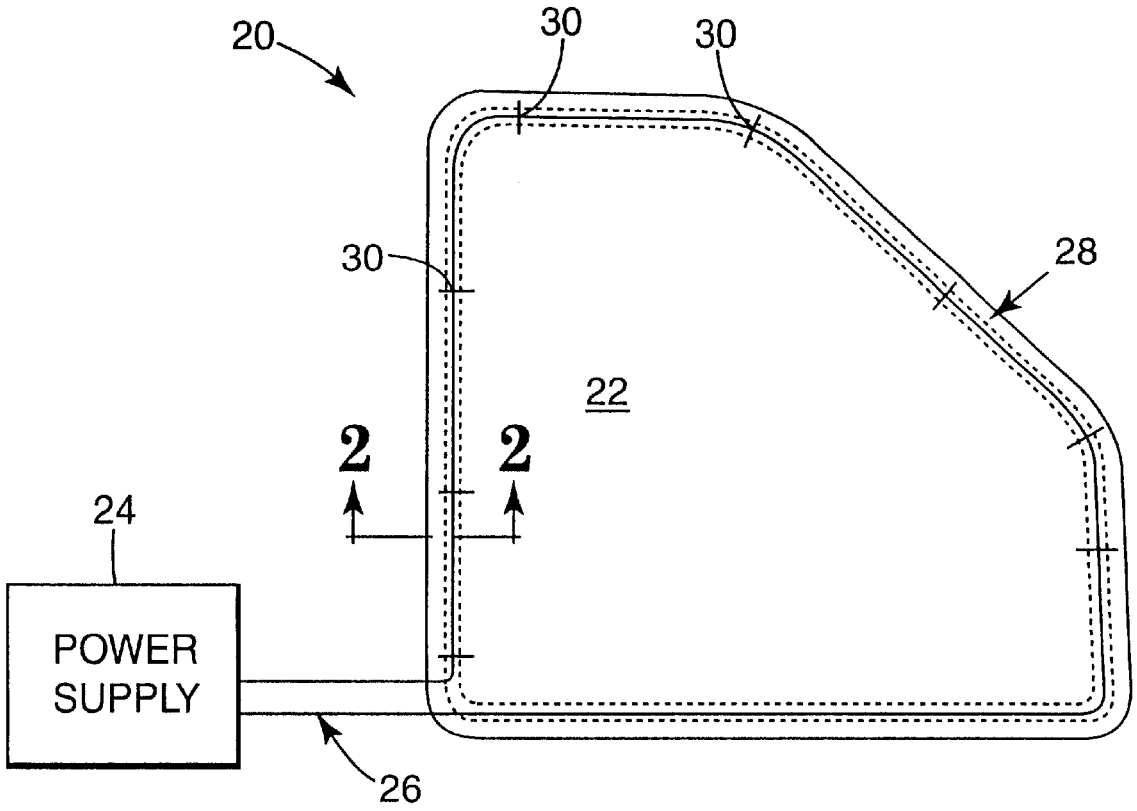
FIG. 1 is a front elevational view of an induction heating apparatus in accordance with the present invention, shown in an operational position.

In FIG. 1, an induction heating apparatus in accordance with the present invention is generally indicated at 20. The induction heating apparatus 20 is shown in an operational position adjacent a panel assembly (e.g., an automotive panel assembly) 22. In operation, the induction heating apparatus 20 operates to reduce the cure time of a shaped, substantially continuous bondline (i.e., the bondline does not have to be totally continuous) defined by a thermally responsive bonding material positioned between two members, wherein the induction heating apparatus 20 includes a manually reshapeable cable assembly positionable adjacent the shaped bondline along its length. The induction heating apparatus 20 provides for controlled uniform heating of the shaped bondline along its length, including uniform heating of bondlines within a two-dimensional and three-dimensional space. The reshapeable cable assembly is positionable in a non-dipole (as shown) or a dipole configuration adjacent the bondline. The induction heating apparatus in accordance with the present invention has many uses, including auto repair, home repair, airplane industry, agricultural and industrial machinery, etc., including for use with adhesives, sealants, or for the controlled, uniform melting of other materials. Other uses will become apparent to those skilled in the art after reading the present application.

Induction heating apparatus 20 includes an alternating current power supply 24 electrically coupled to a flexible, reshapeable cable assembly 26. Panel assembly 22 includes a first bondline 28 having a first shape. In the exemplary embodiment shown, the first shape of the first bondline 28 corresponds to the shape of the perimeter edge of panel assembly 22.

The flexible, reshapeable cable assembly 26 is positioned along the first bondline 28. In particular, the flexible, reshapeable cable assembly 26 is manually shapeable to the first shape of the first bondline. Further, the flexible, reshapeable cable assembly 26 is capable of being manually reshaped to a second shape of a second bondline different than the first shape of the first bondline. A securing mechanism 30 is provided for releasably securing the flexible, reshapeable cable assembly 26 to the panel assembly 22. In one preferred embodiment, the securing mechanism 30 comprise metallic or non-metallic clips or fixturing clamps. Other securing mechanisms may be used, such as adhesive-backed members (e.g., tape) or a magnetic member for magnetically securing (i.e., coupling) the flexible, reshapeable cable assembly 26 to the panel assembly 22. Other suitable securing mechanisms will become apparent to those skilled in the art after reading the disclosure of the present application.

Power supply 24 is an alternating current power supply. Power supply 24 is a high frequency power supply, preferably having an output frequency greater than 1 kilohertz. In one preferred embodiment, the output frequency of power supply 24 is between 10 kilohertz and 400 kilohertz.

The flexible, reshapeable cable assembly 26 is a single cable positioned along bondline 28, and as shown is positioned in a simple, non-dipole manner. Such a configuration allows for uniform heating of bondline 28 along its length. In the exemplary embodiment shown, the controlled, uniform heating does not require an additional cooling mechanism, but rather cools naturally. At higher temperatures, additional cooling would be required. In one embodiment, the flexible, reshapeable cable assembly 26 includes a plurality of wires, and more preferably, is a litz wire. The flexible, reshapeable cable assembly 26 is described in detail later in the specification. Alternatively, the cable assembly 26 is operably positionable in a dipole configuration adjacent the bondline 28.

Figure 2:
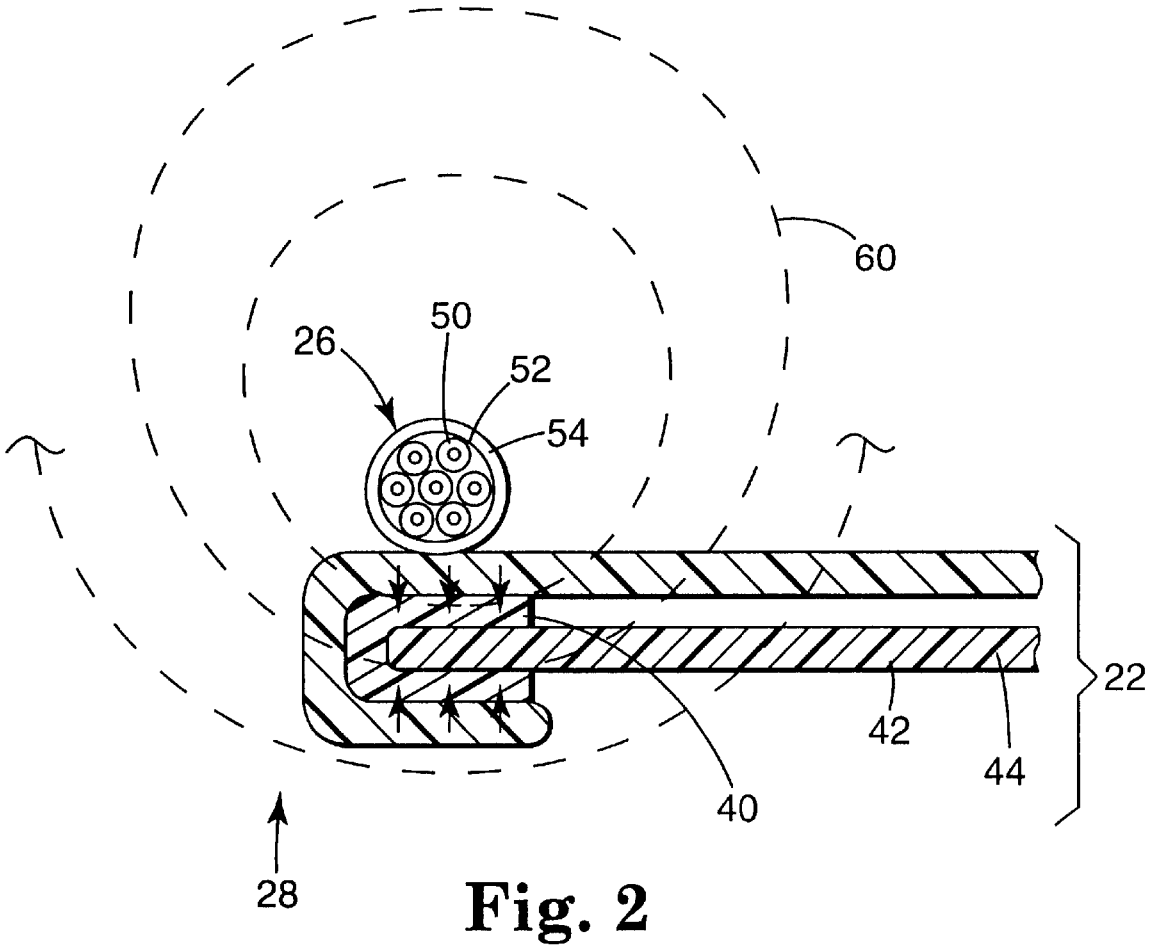
FIG. 2 is a cross-sectional view taken along line 2—2 of FIG. 1.

FIG. 2 is a cross-sectional view taken along lines 2—2 of FIG. 1 illustrating one exemplary embodiment of an application flexible, reshapeable cable assembly 26 operably positioned adjacent first bondline 28 of panel assembly 22. Panel assembly 22 includes a thermally responsive material 40 positioned between a first member 42 and a second member 44. First member 42 or first member 44 is made of an electrically conductive material (e.g., sheet metal). In one application, first member 42 is part of an automobile metal structure, and second member 44 is an automobile exterior sheet member or panel. Electrically conductive material, as used herein, may also include adhesives which are heavily loaded such that they have continuous DC conductivity or loaded adhesives which conduct electricity at higher frequencies.

Thermally responsive bonding material 40 is a bonding material in which the cure time is reduced (i.e., the cure rate is accelerated) when heated. Bonding material 40 can be a one-part or two-part bonding material (e.g., adhesive) as known to those skilled in the art. One exemplary embodiment of a two-part bonding material is available under the Tradename 3M Automix Panel Bonding Adhesive commercially available from 3M Company of St. Paul, Minn. As used herein, the term thermally responsive bonding materials also includes sealants such that the present invention may be used to aid in the spreading of "hot melt" sealants. Other thermally responsive bonding materials include thermal settable polymers, including epoxys, polyesters, acrylates, urethanes or other useful thermally responsive bonding materials or material blends. Such materials may also include thermally activated curing agents incorporated into the compositions. Further, such bonding materials may include an accelerator added to the composition, so that it will fully cure or achieve handling strength at a lower temperature, or to reduce the cure time when exposed to heat for shorter periods. Other thermally responsive bonding materials will become apparent to those skilled in the art after reading the disclosure of the present application.

Flexible, reshapeable cable assembly 26 is shown operably positioned adjacent the panel assembly 22 first bondline 28 along its length. In one embodiment, flexible, reshapeable cable assembly 26 comprises a plurality of wires 50 (e.g., 600 wires, only 7 shown), and more preferably, is a litz wire including 100–1,000 or more wires 50. In one application, each wire has a diameter between 0.03 and 0.15 mm. In one application, each wire 50 includes an insulated cover layer 52 to define an insulated wire. In one aspect, the insulated cover 52 is made of a polymeric material (e.g., a thermoplastic resin enamel). Optionally, a jacket or second insulating layer 54 surrounds wires 50. In one preferred embodiment, the jacket layer 54 is made of a polymeric material.

A plurality of insulated wires is preferred to form flexible, reshapeable cable assembly 26 to maximize the current carrying surface area of the cable assembly. In particular, since conductors carry the electrons (i.e., current) near their surface at higher frequencies, utilizing a number of small insulated wires results in a larger total conductor surface area which can carry more current than a single wire or tubing with less resistive losses at higher frequencies. As such, the resistance of the cable assembly does not undesirably increase for higher frequency applications. This is especially more desirable than the use of a conventional rigid, copper wire or tubing.

In one preferred embodiment, the flexible, reshapeable cable assembly 26 is a litz wire cable assembly. Litz wire is commercially available from multiple sources, including WireTronic, Inc. of Calabarra, Calif., USA.

Litz wire construction is designed to minimize the power losses exhibited in solid conductors due to "skin effect" (previously indicated above). The skin effect is the tendency of radio frequency current to be concentrated at the surface of the conductor. The litz wire construction counteracts this effect by increasing the amount of surface area without significantly increasing the size of the conductor. In general, litz wire constructions composed of many strands of finer wires are best suited for higher frequency applications. Polyurethane-nylon is the film most often used for insulating individual strands because of its solderability. However, it is recognized that other higher temperature insulations may be used as well.

Each wire strand is electrically insulated with an insulating enamel commonly used for magnet wire. The most common insulations for litz wires are single and heavy build polyurethane-nylon meeting NEMA MW 80-C (155° C. thermal class) industry standard for magnet wire. Other suitable insulation types and builds may be used. Litz wire may be described as "served" or "unserved". Served litz wire means that the entire litz wire construction is wrapped with a nylon textile or yarn for added strength and protection. Another option is to have the litz wire construction jacketed with FEP teflon®, or PVC instead of nylon. Typical teflon® thickness is 0.005 inches up to 0.015 inches. Teflon is a tradename of Dupont Corporation.

Typical frequency ranges for the litz wire strand size is as follows:

| Frequency in Kilohertz | AWG Strand Size |
|---|---|
| 1–10.0 | 30 |
| 10–50 | 33 |
| 50–100 | 36 |
| 100–200 | 38 |
| 200–400 | 40 |
| 400–800 | 42 |
| 800–1600 | 44 |
| 1600–3200 | 46 |
| 3200–5000 | 48 |

In one preferred embodiment, the flexible, reshapeable cable assembly 26 is a 661 conductor litz wire assembly of 34 AWG copper wires, single build polyurethane-nylon insulation (thermal class 155° C.), with a teflon® jacket. The outside diameter of the cable assembly is between about 0.21 inches and 0.23 inches.

In operation, activation of power supply 24 produces a high frequency current carried by flexible, reshapeable cable assembly 26. The current carrying flexible, reshapeable cable assembly 26 produces a magnetic field which is distributed over an area, indicated by magnetic field lines 60, which cause heating of adjacent electrically conductive materials (e.g., a sheet metal) in close proximity to the flexible reshapeable cable assembly 26. The resultant induction heating of the electrically conductive material is caused by the strong eddy currents induced by the magnetic fields in the electrically conductive material. The inductively heated electrically conductive material (e.g., second member 44) operates to conductively heat thermally responsive bonding material 40, thereby accelerating the cure time of the bonding material 40, preferably to at least handling strength. In one preferred embodiment, first member 42 or second member 44 are made of an electrically conductive material (e.g., sheet metal). Alternatively, exterior member 45 is nonmetallic and member 46 positioned adjacent second member 45 is made of an electrically conductive material (e.g., sheet metal).

Figure 3:
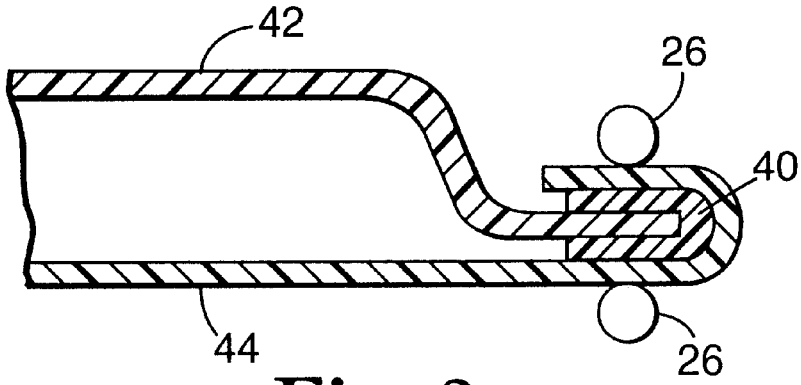
FIG. 3 is a cross-sectional view illustrating one exemplary embodiment of another application of the induction heating apparatus in accordance with the present invention.
Figure 4:
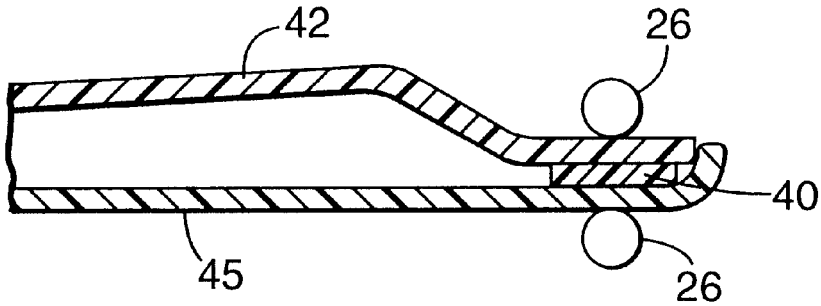
FIG. 4 is a cross-sectional view illustrating one exemplary embodiment of another application of the induction heating apparatus in accordance with the present invention.
Figure 5:
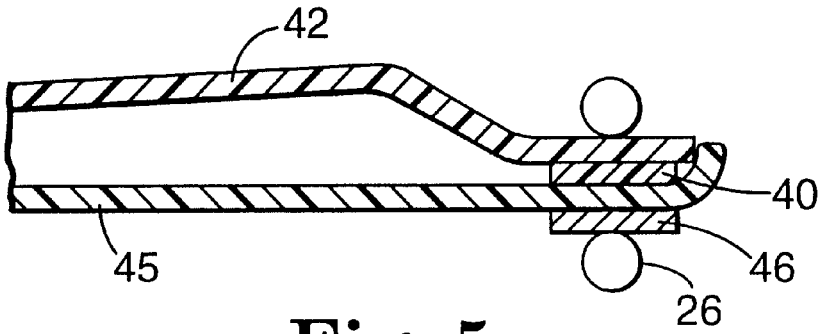
FIG. 5 is a cross-sectional view illustrating one exemplary embodiment of another application of the induction heating apparatus in accordance with the present invention.

In FIGS. 3–5, cross-sectional views are shown illustrating alternative exemplary embodiments of applications of the induction heating apparatus in accordance with the present invention. In particular, in FIG. 3, the flexible, reshapeable cable assembly 26 is positioned adjacent first member 42, and also is positioned adjacent second member 44 allowing for inductive heating from both sides. In FIG. 4, a non-conductive member (e.g., a fiberglass door member) is being bonded to first member 42. Although it is recognized that the flexible, reshapeable cable assembly 26 operates to inductively heat more effectively when positioned on metal or closer to a metallic member, the flexible, reshapeable cable assembly 26 can be operably positioned adjacent to first member 42 and/or adjacent electrically non-conductive member 45. In FIG. 5, a metallic member 46 is provided adjacent the flexible, reshapeable cable assembly 26 to aid in the heating of thermally responsive material 40. In one application shown, metallic member 46 is positioned between the flexible, reshapeable cable assembly 26 and the electrically non-conductive member 45. In operation, metallic member 46 is inductively heated by the flexible, reshapeable cable assembly 26, and heat is transferred conductively to the thermally responsive material 40.

The induction heating apparatus in accordance with the present invention is useful in both a variety of bonding and debonding applications. In a debonding application, the flexible, reshapeable cable assembly is positioned adjacent a bond line for inductive heating of the bond line to a temperature sufficient to "break" the bond or separate bonded workpieces. Similarly, the induction heating apparatus in accordance with the present invention, including the flexible, reshapeable cable assembly 26 is useful in heating a thermally responsive material (e.g., an adhesive or sealant) which is positioned adjacent a first member, but which is not positioned between a first member and a second member. Such an application is very useful for sealants positioned on a substrate which are not positioned between two members. Other applications of the induction heating apparatus in accordance with the present invention including the flexible, reshapeable cable assembly will become apparent to those skilled in the art after reading the specification of the present application.

Figure 6:
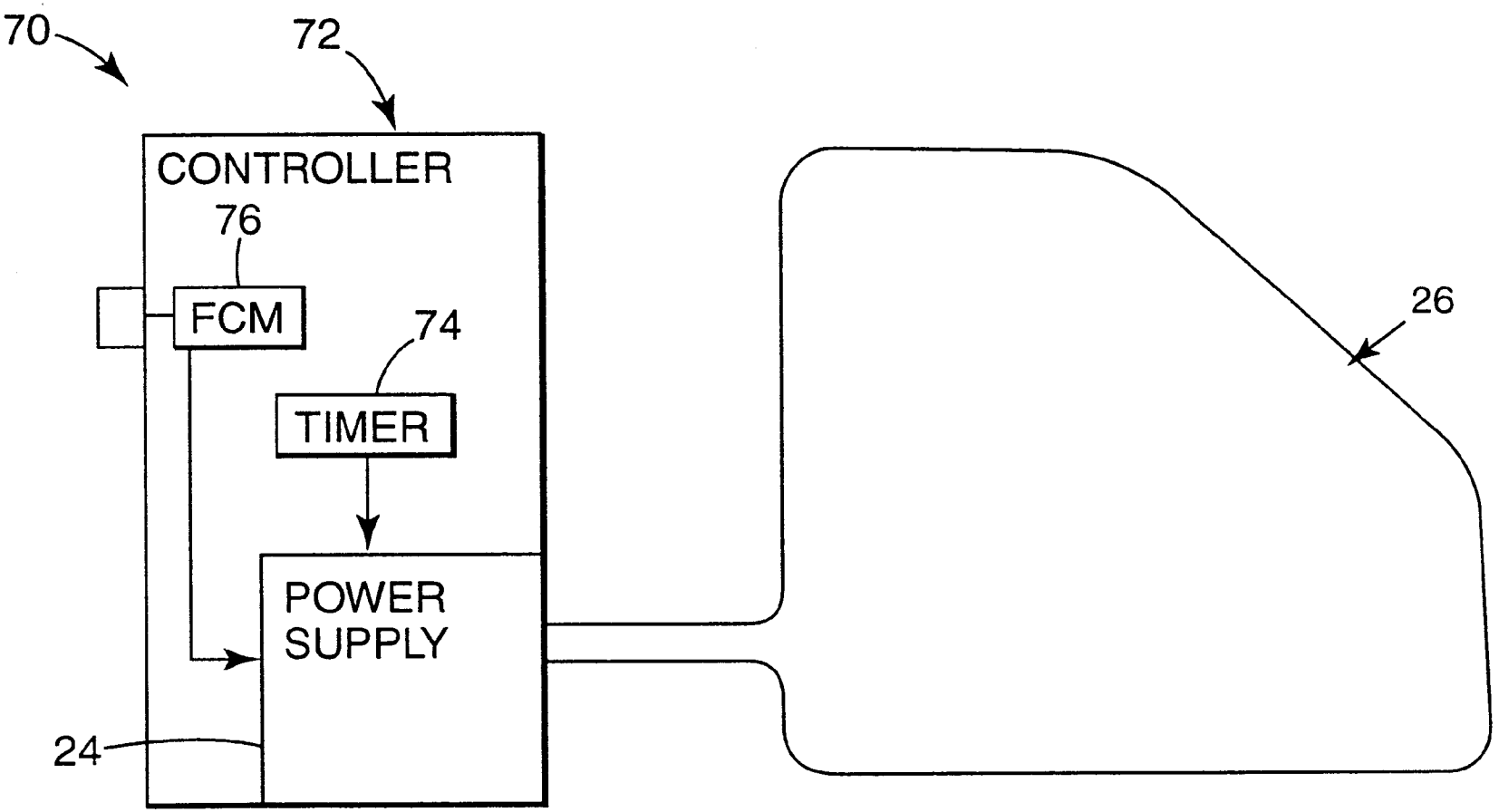
FIG. 6 is a block diagram illustrating one alternative embodiment of an induction heating apparatus in accordance with the present invention.

In FIG. 6, another exemplary embodiment of an induction heating apparatus 20 in accordance with the present invention is shown at 70. Induction heating apparatus 70 is similar to the induction heating apparatus 20 previously described herein. In this embodiment, the induction heating apparatus 20 includes a controller 72 for controlled activation of alternating current power supply 24. In one embodiment, alternating current power supply 24 is an AC to DC to AC high frequency inverter having a pulsed high frequency output (e.g., 2.5 kiloherz to 20 kiloherz pulse rate). In one aspect, controller 72 includes a timer 74 and a frequency control mechanism (FCM) 76. Timer 74 is electrically coupled to power supply 24 for timed activation of power supply 24, thereby controlling the duration of inductive heating via flexible, reshapeable cable assembly 26. Other suitable techniques may be used to control power supply 24, such as with a duty cycle (i.e., selected on time and off time). Such techniques may include applying power for timer limited durations or a pre-set, operator setable duty cycle.

Frequency control mechanism 76 is coupled to power supply 24, and allows a user to control the power output of power supply 24. In one aspect, frequency control mechanism 76 in combination with power supply 24 operates to provide a variable pulse frequency or rate (e.g., 2.5 kiloherz to 20 kiloherz pulse rate) at a fixed output frequency. Operation of frequency control mechanism 76 to increase the pulse rate increases the power output to the flexible, reshapeable cable assembly 26. Controller 72 may include other control mechanisms for controlling the operation of induction heating apparatus 70. Controller 72 may include a computer, microprocessor, logic gates, or other components capable of performing a sequence of logical operations for selective control of induction heating apparatus 20 and allowing the induction heating apparatus 70 to interface with other systems.

Figure 10:
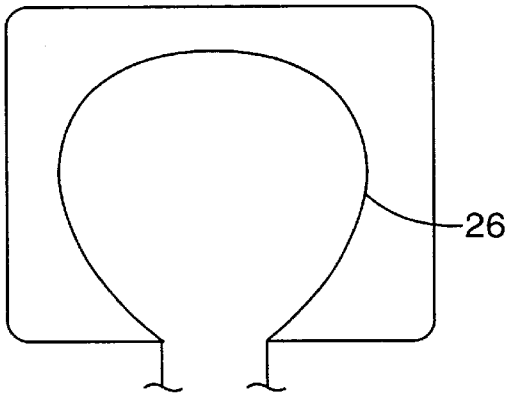
FIGS. 7–11 illustrate exemplary embodiments of two-dimensional or three-dimensional positioning of a manually reshapeable cable assembly in accordance with the present invention.
Figure 11:
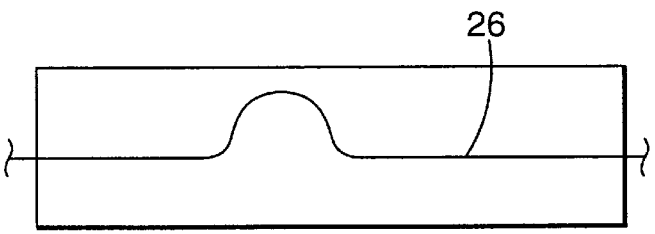
Figure 9:
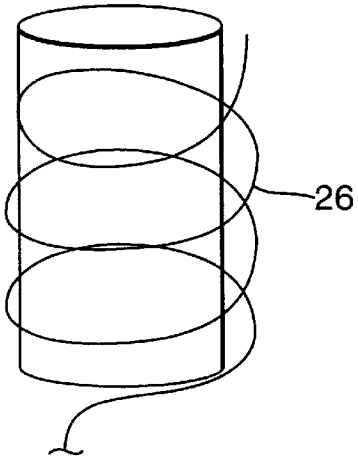
Figure 8:
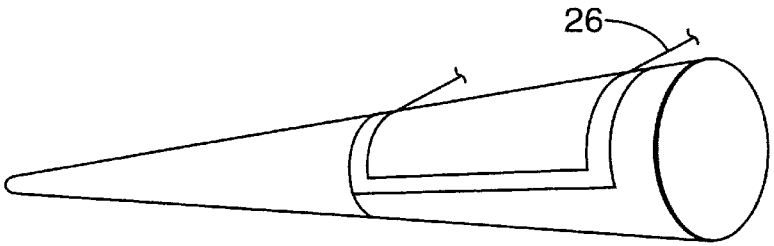
Figure 7:
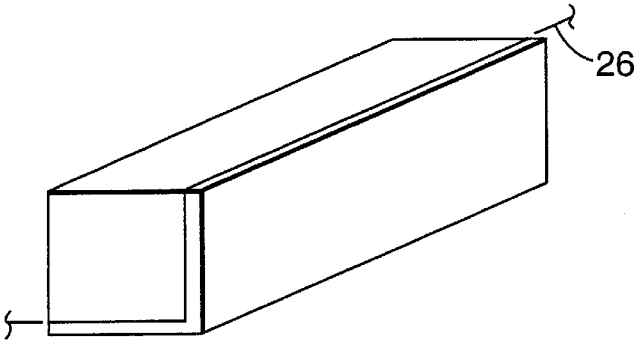

In FIGS. 7–11, exemplary embodiments are shown illustrating the two-dimensional and three-dimensional shaping ability of flexible, manually reshapeable cable assembly 26. Further, once manually formed into a desired shape, the cable assembly 26 is substantially non-resilient, and as such retains the desired configuration until repositioned and formed into a second shape. For example, in FIG. 7 the cable assembly 26 is positionable in three-dimensional space about a rectangular shaped object to cure a three-dimensional bondline. In FIG. 8, the cable assembly 26 is positionable in three-dimensional space along a curved surface of a cone-shaped object to cure a three-dimensional bondline. In FIG. 9, the cable assembly 26 is positioned in three-dimensional space about a cylinder-shaped object to cure a three-dimensional bondline. In FIG. 10, the cable assembly 26 is positioned along a bondline in a two-dimensional space in a substantially arc-shaped manner, wherein the arc extends beyond 180°. Similarly, in FIG. 11 the cable assembly 26 is shown positioned in a two-dimensional space.

Figure 12:
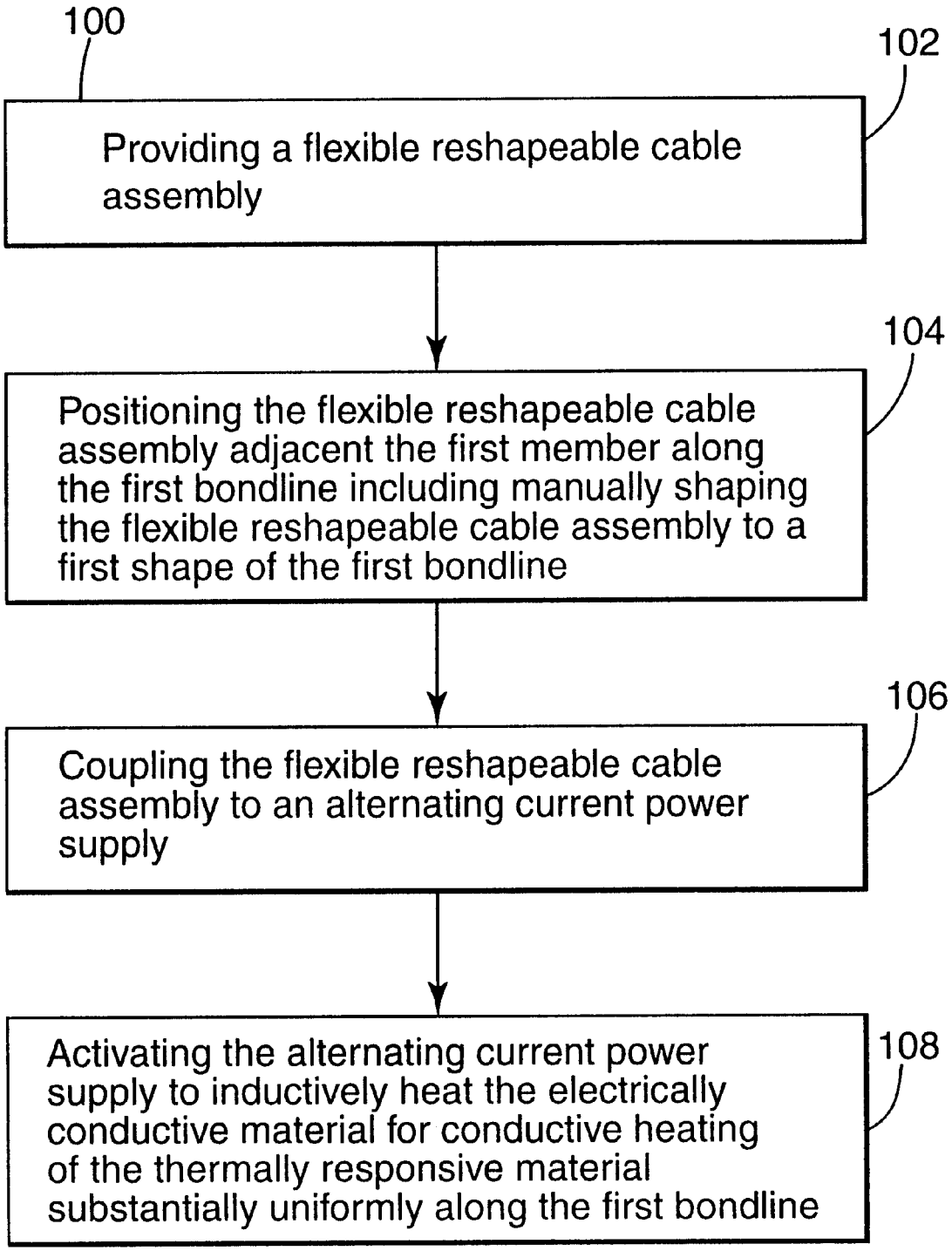
FIG. 12 is a flow diagram illustrating one exemplary embodiment of a method for accelerating curing of bonded members using the induction heating apparatus in accordance with the present invention.

In FIG. 12, one exemplary embodiment of a method of bonding or debonding two juxtaposed members in accordance with the present invention is illustrated at 100. The method reduces the curing time of a thermally responsive bonding material positioned between a first member and a second member which defines a substantially continuous bondline, wherein the first member or the second member is made of an electrically conductive material or positioned adjacent an electrically conductive material. The method is also useful in heating a thermally responsive material (e.g., an adhesive or sealant). In step 102, a flexible, reshapeable cable assembly is provided. In one aspect, the flexible, reshapeable cable assembly is defined as a plurality of wires stranded together. An insulating layer covers each wire forming an insulated wire. A jacket layer covers all of the insulated wires. More preferably, the cable assembly is a litz wire.

In step 104, the flexible, reshapeable cable assembly 26 is positioned adjacent the first member along the first bondline, including manually shaping the flexible, reshapeable cable assembly 26 to a first shape of the first bondline. The flexible, reshapeable cable assembly 26 retains the shape of the first shape, but is manually reshapeable to a different shape. In step 106, the flexible, reshapeable cable assembly is coupled to an alternating current power supply 24. The alternating current power supply 24 is a high frequency power supply having an output frequency of greater than 1 kilohertz. In one preferred embodiment, the output frequency is between 25 and 400 kilohertz. A controller 72 may be coupled to the power supply for controlling activation of the power supply. In step 108, the alternating current power supply is activated to inductively heat the electrically conductive material for controlled conductive heating of the thermally responsive material substantially uniformly along the first bondline.

The flexible, reshapeable cable assembly 26 may be secured to the first bondline along its length. The flexible, reshapeable cable assembly 26 is removable from the first bondline, and manually reshaped to a second shape of a second bondline, different from the first shape of the first bondline.

One example illustrating a specific use of the induction heating apparatus 20 in accordance with the present invention is detailed in the following paragraphs. In this application, the induction heating apparatus 20 was utilized for reducing the cure time of a thermally responsive bonding material utilized for bonding an exterior metal panel of a vehicle to the vehicle structure. The thermally responsive bonding material utilized is 3M Panel Bonding Adhesive 8115. First, all paint and rust is removed from the surfaces to be bonded using a 36 or 50 grit abrasive disk. The replacement panel is "dry-fit" to the vehicle structure, partially clamped in place and checked for fit and alignment. The replacement panel is then removed from the vehicle. The areas to be bonded are cleaned with soap and water.

3M General Purpose Adhesive Cleaner or 3M Super Fast Adhesive Cleaner are used to remove any grease, wax, and/or tar from the bonding surface.

Adhesive (i.e., the thermally responsive bonding material) is applied to all areas to be bonded. A plastic spreader is used to tool out the adhesive which may be used to provide a base for an additional adhesive bead. An adhesive bead was applied approximately one quarter inch from the inside edge of the replacement panel. The replacement panel was then fit in proper alignment with the vehicle structure and fixed using clamps to prevent any movement.

A 0.29 inch by 33 foot litz wire is utilized for the flexible, reshapeable cable assembly. The cable assembly is coupled to a 1500 watt, 120 VAC, 25–50 kilohertz variable power supply. The cable assembly was positioned in a non-dipole manner on the substantially continuous bondline along its length and the power supply was activated. The power supply includes a rheostat to control the current to the cable assembly, thereby controlling the heating of the bonding adhesive. The rheostat was set at 85%, and the metal replacement panel reached a temperature of 200° F. in 10 minutes. The temperature had not yet reached a steady state, but the adhesive squeeze-out had hardened indicating sufficient cure had occurred to hold the parts together without fixturing clamps (i.e., achievement of handling strength). The power to the power supply was turned off and the replacement panel was allowed to cool to less than 100° F., taking approximately 10 minutes. The clamps were removed. The total time for adhesive application, heat curing and cooling was less than 30 minutes. Heating was only necessary to quickly attain handling strength to permit removal of the clamps. The induction heating apparatus reduced the time to reach handling strength by over 3½ hours.

Numerous characteristics and advantages of the invention have been set forth in the foregoing description. It will be understood, of course, that this disclosure is, and in many respects, only illustrative. Changes can be made in details, particularly in matters of shape, size and arrangement of parts without exceeding the scope of the invention. The invention scope is defined in the language in which the appended claims are expressed.

What is claimed is:

1. An inductive heating apparatus for heating a substantially continuous first bondline defined by a length of thermally responsive bonding material positioned between a first member and a second member, wherein the first member or second member is made of an electrically conductive material or positioned adjacent an electrically conductive material, the inductive heating apparatus comprising:

a flexible, reshapeable cable assembly comprising:

(a) a plurality of wires stranded together;

(b) a first insulating layer covering each wire forming an insulated wire; and (c) a jacket layer covering all of the insulated wires;

wherein the cable assembly is operably positionable adjacent the first member along the first bondline, wherein the flexible, reshapeable cable assembly is capable of being manually shaped to a first shape of the first bondline, and is capable of being manually re-shaped to a second shape of a second bondline different than the first shape of the first bondline; and an alternating current power supply electrically coupled to the flexible, reshapeable cable assembly, wherein when the alternating current power supply is activated the reshapeable cable assembly operates to inductively heat the electrically conductive material for conductive heating of the thermally responsive bonding material substantially uniformly along the first bondline.

2. The inductive heating apparatus of claim 1, wherein the flexible, reshapeable cable assembly is positionable in a non-dipole or dipole configuration adjacent the first bondline.

3. The inductive heating apparatus of claim 1, further wherein the flexible, reshapeable cable assembly is positionable adjacent the second member along the first bondline.

4. The inductive heating apparatus of claim 1, wherein the first insulating layer is made of a polymeric material.

5. The inductive heating apparatus of claim 1, wherein the jacket layer is made of a polymeric material.

6. The inductive heating apparatus of claim 1, wherein the diameter of each wire ranges between 0.03 and 0.5 millimeters.

7. The inductive heating apparatus of claim 1, wherein the flexible, reshapeable cable assembly is a litz wire.

8. The inductive heating apparatus of claim 1, wherein the alternating current power supply has an output frequency greater than 1 kilohertz.

9. The inductive heating apparatus of claim 8, wherein the output frequency is between 25 khz and 400 khz.

10. The inductive heating apparatus of claim 8, wherein the controller further comprises a timer for controlling the duration of application of power via the power supply.

11. The inductive heating apparatus of claim 1, further comprising a controller coupled to the power supply for controlling activation of the power supply.

12. The inductive heating apparatus of claim 11, wherein the power supply has an output pulse frequency and wherein the controller further includes a frequency control mechanism for changing the output pulse frequency.

13. The inductive heating apparatus of claim 1, further comprising a securing mechanism for securing the flexible, reshapeable cable assembly to the first member.

14. The inductive heating apparatus of claim 13, wherein the securing mechanism is tape.

15. The inductive heating apparatus of claim 13, wherein the securing mechanism includes a magnetic material for magnetically coupling the cable assembly to the first member.

16. The inductive heating apparatus of claim 1, wherein the securing mechanism is a fixturing clamp.

17. The inductive heating apparatus of claim 1, wherein the first member is a sheet, and the flexible, reshapeable cable assembly is manually formed to substantially a perimeter shape of the sheet.

18. The inductive heating apparatus of claim 1, wherein the flexible, reshapeable cable assembly has three-dimensional conformability.

19. The inductive heating apparatus of claim 1, wherein the flexible, reshapeable cable assembly is substantially non-resilient.

* * * * *